US007350588B2

(12) United States Patent
Abercrombie Simpson et al.

(10) Patent No.: US 7,350,588 B2
(45) Date of Patent: Apr. 1, 2008

(54) METHOD AND APPARATUS FOR SUPPORTING A TUBULAR IN A BORE

(75) Inventors: Neil Andrew Abercrombie Simpson, Scotland (GB); Simon John Harrall, Houston, TX (US); Jon Eric Lauritzen, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 246 days.

(21) Appl. No.: 10/866,320

(22) Filed: Jun. 11, 2004

(65) Prior Publication Data

US 2005/0121202 A1 Jun. 9, 2005

(30) Foreign Application Priority Data

Jun. 13, 2003 (GB) ..... 0313664.5

(51) Int. Cl.
*E21B 43/10* (2006.01)
*E21B 23/00* (2006.01)

(52) U.S. Cl. ..... 166/382; 166/217; 166/208

(58) Field of Classification Search ..... 166/382, 166/206–208, 217
See application file for complete search history.

(56) References Cited

U.S. PATENT DOCUMENTS

| | | | | |
|---|---|---|---|---|
| 3,741,589 | A | 6/1973 | Herd et al. | |
| 3,893,717 | A | 7/1975 | Nelson | |
| 3,948,321 | A | 4/1976 | Owen et al. | |
| 4,730,851 | A | 3/1988 | Watts | |
| 4,832,125 | A * | 5/1989 | Taylor | 166/348 |
| 6,425,444 | B1 | 7/2002 | Metcalfe et al. | |
| 6,446,323 | B1 * | 9/2002 | Metcalfe et al. | 29/523 |
| 6,499,537 | B1 * | 12/2002 | Dewey et al. | 166/255.1 |
| 6,591,905 | B2 | 7/2003 | Coon | |
| 6,752,215 | B2 * | 6/2004 | Maguire et al. | 166/380 |
| 6,877,567 | B2 | 4/2005 | Hirth | |

(Continued)

FOREIGN PATENT DOCUMENTS

| | | |
|---|---|---|
| GB | 2 033 942 | 5/1980 |
| WO | WO 03/048519 | 6/2003 |
| WO | WO 03/058022 | 7/2003 |

OTHER PUBLICATIONS

GB Search Report dated Nov. 13, 2003 from GB Application No. 0313664.5.

*Primary Examiner*—Jennifer H. Gay
*Assistant Examiner*—Shane Bomar
(74) *Attorney, Agent, or Firm*—Patterson & Sheridan, L.L.P.

(57) ABSTRACT

A method of supporting a tubular within a bore including the steps of at least partially expanding a sleeve into contact with a bore wall to secure the sleeve within the bore, and engaging a portion of the tubular to be supported with the sleeve to provide hanging support for the tubular. In one embodiment, the sleeve is expanded by engagement with the tubular. In another embodiment, the sleeve is initially expanded using a roller expansion tool, with further expansion being achieved by way of engagement of the tubular with the sleeve.

An apparatus for supporting a tubular within a bore in one embodiment comprises an expandable sleeve having a first surface and being adapted to be expanded into contact with a bore wall, and a conical portion adapted to be coupled to a tubular, the conical portion having a second surface adapted to engage the first surface of the sleeve.

52 Claims, 5 Drawing Sheets

U.S. PATENT DOCUMENTS

| | | | | |
|---|---|---|---|---|
| 7,066,259 | B2 * | 6/2006 | Duggan et al. | 166/277 |
| 7,104,322 | B2 * | 9/2006 | Whanger et al. | 166/277 |
| 2003/0047323 | A1 | 3/2003 | Jackson et al. | |
| 2003/0098164 | A1 * | 5/2003 | Hirth | 166/382 |
| 2003/0121558 | A1 * | 7/2003 | Cook et al. | 138/98 |
| 2005/0230123 | A1 * | 10/2005 | Waddell et al. | 166/382 |

* cited by examiner

METHOD AND APPARATUS FOR SUPPORTING A TUBULAR IN A BORE

CROSS-REFERENCE TO RELATED APPLICATIONS

This application claims benefit of Great Britain patent application serial number GB 0313664.5, filed Jun. 13, 2003, which is herein incorporated by reference.

BACKGROUND OF THE INVENTION

1. Field of the Invention

The present invention relates to a method and apparatus for supporting a tubular within a bore, and in particular, but not exclusively, to a method and apparatus for supporting liner tubing within a cased subterranean bore.

2. Description of the Related Art

In the oil and gas exploration and production industry, subterranean bores are drilled from surface to intercept hydrocarbon bearing formations, which often requires bore reaches of as much as 6000 to 10000 metres, for example. In conventional drilling operations, a bore is drilled to a depth of around, for example, 600 metres, when the drill bit and associated drill string is then removed and a string of casing run in and cemented in place to support and seal the bore. Drilling is then recommenced for a further 600 metres, for example, following which a further string of casing is required to support the bore. However, in this case the casing is normally tied back to, and supported from the surface by the wellhead. This procedure is repeated until the bore reaches or nears the required total depth. Once the final drilling stage is completed the drilling string is pulled out of the hole and the final bore section is supported by a liner casing string which does not extend back to the wellhead, but instead terminates downhole and is supported by the previous full string of casing. Thus, special liner hangers are required to allow the liner string to be coupled to and supported by the previous casing string.

Conventional liner hangers may be initially coupled to the liner string which is run in hole to the required depth using a setting tool string, and the liner hanger is then set in place within the bore. Typical liner hangers are set in place by mechanical activation of slips or the like, which are brought into engagement with the wall of the bore, thus providing support for the liner.

It is among the objects of embodiments of the present invention to provide an improved method and apparatus for providing hanging support for a liner.

SUMMARY OF THE INVENTION

According to a first aspect of the present invention, there is provided a method of supporting a tubular within a bore, said method comprising the steps of:

- providing a tubular defining a first support surface;
- providing an expandable sleeve adapted to be peripherally located around said tubular, said expandable sleeve defining a second support surface;
- locating said tubular and expandable sleeve within a bore;
- expanding at least a portion of said sleeve into engagement with the bore; and
- at least partially supporting the tubular by way of engagement of the first and second support surfaces.

It should be understood that the expandable sleeve may be initially located within the bore and at least partially expanded in place before the tubular is located within the bore. Alternatively, the expandable sleeve and the tubular may be located within the bore simultaneously.

It should also be understood that the sleeve is expanded into engagement with a bore wall.

In one embodiment of the present invention, at least a portion of the sleeve may be initially expanded into engagement with the wall surface of the bore in which the tubular is to be supported by an expansion tool such as a roller expansion tool or an expansion cone or mandrel or the like. In this case the expandable sleeve may be run into the bore on the expansion tool, and at least partially expanded into contact with the bore wall using the expansion tool to provide initial hanging support at the required depth. Subsequently, the tubular may be run into the bore until the first support surface of the tubular engages the second support surface of the sleeve, at which stage weight may be applied to the tubular resulting in further expansion of the sleeve by interaction of the first and second support surfaces, thus providing additional gripping force between the sleeve and the bore wall to support the weight of the tubular. In this regard, the first support surface of the tubular may act as a swage and expands the sleeve by a swage expansion.

Advantageously, where expansion is achieved using a roller expansion tool, the expandable sleeve undergoes circumferential yield causing the wall thickness of the sleeve to be reduced.

In an alternative embodiment of the present invention, the method may involve the initial step of locating the expandable sleeve peripherally around the tubular in the region of the first support surface. Preferably, the sleeve is initially located below the first support surface of the tubular. Conveniently, the following step may involve running the tubular and the expandable sleeve into the required bore together until the expandable sleeve is located at the required depth. Once the required depth is achieved, relative axial movement of the tubular and expandable sleeve may be initiated to cause engagement of the first and second support surfaces, wherein said engagement results in radial expansion of at least a portion of the sleeve into contact with the wall surface of the bore, providing support for the tubular via the first and second support surfaces. The expansion of the expandable sleeve is thus provided by effectively forcing the tubular through the sleeve or alternatively forcing the sleeve over the tubular. Thus, the first support surface of the tubular may act as a swage to expand the sleeve by a swage expansion process.

Preferably, expansion of the sleeve using the first support surface as a swage expander, for example, is achieved by initially restraining the first support surface from movement while moving or forcing the expandable sleeve and thus the second support surface into engagement with the first support surface to initiate expansion of the sleeve. Alternatively, the expandable sleeve may be held stationary while moving the first support surface into engagement with the second support surface of the sleeve. For example, the sleeve may be prevented from travelling further into the bore by a no-go or a profile located on the inner wall surface of the bore, against which no-go or profile the sleeve abuts when run in hole. Alternatively, the sleeve may be held stationary by fixing means associated with the tubular such that the sleeve may be expanded into contact with the bore wall at any required depth.

Advantageously, relative movement of the expandable sleeve and the tubular may be achieved by an actuation assembly such as a piston assembly activated by fluid pressure. Alternatively, relative movement may be achieved by a mechanical actuation assembly such as a screw assembly, or by any other suitable actuation assembly. The actuation assembly may be, for example, located below the expandable sleeve and activated to force or push the sleeve towards the first support surface. Alternatively, the actuation assembly may be located above the expandable sleeve and the first support surface of the tubular and activated to force or pull the sleeve towards the first support surface. In this preferred embodiment, the at least one actuation assembly may be coupled to the expandable sleeve by at least one strap or other fixed coupling such as a shear pin or a bolt or the like.

Conveniently, where the actuation assembly is located above the first support surface and is coupled to the expandable sleeve by at least one strap, as noted above, said first support surface includes at least one respective channel or recess to accommodate said at least one strap. Thus, the at least one channel or recess will substantially reduce or eliminate any interference by the first support surface.

In a preferred embodiment where the expandable sleeve is expanded by interaction of the first and second support members, the method preferably comprises the steps of:

- locating the expandable sleeve and tubular within a bore at the required depth;
- restraining said tubular from movement and activating the actuation assembly to pull the sleeve, and thus the second support surface, towards the first support surface of the tubular via at least one connecting strap, thus initiating radial expansion of the sleeve into engagement with the bore wall by engagement of the first and second support surfaces to provide initial hanging support;
- imparting weight on the tubular to initiate further radial expansion of the sleeve to increase the grip force between the sleeve and the bore wall; and
- exerting an increasing force on the sleeve by the actuation assembly to ensure sufficient expansion of the sleeve to provide support for the tubular via the first and second support surfaces.

Preferably, the method further involves inducing tensile failure of the at least one strap to ensure sufficient expansion has been achieved. Thus, the actuation assembly is preferably adapted to exert a force at least equivalent to the tensile strength of the at least one strap.

Preferably, the first and second support surfaces of the tubular and sleeve respectively are substantially complementary in shape to allow proper engagement to provide support for the tubular from the expandable sleeve, and to allow expansion of the sleeve by the tubular, where required.

Conveniently, the outer diameter described by the first support surface decreases in a direction corresponding to a downward direction with respect to a bore in which the tubular is to be located. Conveniently also, the inner diameter described by the second support surface decreases in a direction corresponding to a downward direction with respect to a bore in which the expandable sleeve is to be located.

Preferably, the first support surface of the tubular defines, at least partially, an outer frusto-conical surface portion. Advantageously, the second support surface defines, at least partially, a complementary inner frusto-conical surface portion adapted to be mated or brought into abutment with the outer frusto-conical surface portion of the first support surface upon engagement therewith. Conveniently, where the first and second support surfaces define complementary frusto-conical surface portions, the taper of the surface portions may be less than around 16° from a plane substantially parallel to the longitudinal axis of the tubular. Preferably, the taper of the surface portions is between 3 to 8°.

Alternatively, the first support surface of the tubular may define, at least partially, an outer convex surface portion, and the second support surface may define, at least partially, a complementary inner concave portion adapted to be mated or brought into abutment with the outer convex portion of the first support member upon engagement therewith. That is, the first and second support surfaces may be described by a radius of curvature such that the second support surface defines a bowl structure which receives or abuts the complementary shaped first support surface.

It should be understood, however, that any complementary shape or configuration of the first and second support surfaces of the tubular and expandable sleeve respectively may be utilised.

Advantageously, the expandable sleeve may include a substantially cylindrical portion, which cylindrical portion may be adapted to be at least partially expanded into engagement with a bore wall surface to provide initial hanging support before the remainder of the expandable sleeve is expanded into contact with the bore wall. Preferably, the cylindrical portion is located above the second support surface of the sleeve. Thus, the cylindrical portion, at least once partially expanded, will allow the tubular and first support surface to pass therethrough to engage the second support surface of the sleeve. Alternatively, the cylindrical portion of the expandable sleeve may be located below the second support surface.

It should be understood that the term "below" as used herein generally defines relative positions of various components such that a lower component will, in use, be located at a deeper location in the bore. Similarly, it should be understood that the term "above" generally implies that a component is located at a more elevated location in the bore.

Advantageously, at least a portion of an outer surface of the expandable sleeve is roughened or otherwise formed or adapted to increase the friction and thus grip between the sleeve and the bore wall. The outer surface of the sleeve may be textured, profiled or may additionally or alternatively include hardened or coarse particles embedded therein or coupled thereto. Such particles may be, for example, carbide or diamond buttons or the like.

Conveniently, once the expandable sleeve is expanded and set in place within the bore, and the first and second support surfaces are in engagement such that the tubular is supported by the sleeve, sufficient sealing is provided between the outer surface of the sleeve and the bore wall, and between the first and second support surfaces to prevent the passage of any fluids, such as cement, past the sleeve from an annulus formed between the tubular and the bore. Conveniently, a sealing material may be provided on at least a portion of the outer surface of the sleeve in order to seek to improve sealing between the sleeve and bore wall when the sleeve is expanded. The sealing material may be an elastomer or any other suitable material which is resistant to degradation in a hydrocarbon producing bore environment, for example. The sealing material by comprise a swelling elastomer adapted to swell in the presence of a fluid containing, for example water, drilling mud or lubricant or hydrocarbons.

In one embodiment of the present invention, the first support surface may be integrally formed with the tubular. In an alternative embodiment, the first support surface may be provided on a separate component which is subsequently coupled or fixed to the tubular. For example, the first support surface may be provided on a further tubular member which is coupled to the tubular by way of a threaded connection or the like.

The bore in which the tubular is to be located and supported may be lined or unlined. For example, the bore may be supported and sealed by casing tubulars cemented in place within the bore such that the expandable sleeve is radially expanded into contact with the inner wall of the casing.

Preferably, the tubular to be supported within the bore is a string of liner tubing or the like.

Conveniently, once the sleeve has been expanded and the tubular is supported with the bore, the tubular may be lifted from the sleeve to disengage the first and second support surfaces, thus creating a flow passage past the sleeve from an annulus defined between the tubular and the bore wall. This is particularly advantageous in that the flow passage will allow any fluids contained within the annulus to be displaced therefrom during a cementing operation or the like. Additionally, the flow path will allow cement to flow past the sleeve in an up-hole direction to cement the tubular within the bore both above and below the sleeve.

Conveniently also, once the sleeve has been expanded and the tubular is supported within the bore, the tubular may be lifted from the sleeve and rotated to assist circulating and evenly distributing cement, for example, within the annulus formed between the tubular and the bore wall during a cementing operation.

Thus, the engagement between the first and second support surfaces of the tubular and sleeve respectively is preferably non-permanent.

According to a second aspect of the present invention, there is provided a method of supporting a tubular within a bore, said method comprising the steps of:

providing a tubular defining an outer support surface;

providing an expandable sleeve defining an inner support surface;

running said expandable sleeve into a bore to a first depth and expanding at least a portion of said sleeve into contact with a wall of the bore;

running said tubular into the bore;

engaging the outer support surface of the tubular with the inner support surface of the expandable sleeve; and supporting the tubular by engagement of the outer and inner support surfaces.

Preferably, the method further involves the step of applying weight to the tubular upon engagement of the outer and inner support surfaces to effect further expansion of the sleeve by interaction of the outer and inner support surfaces, thus providing additional gripping force between the sleeve and the bore wall to support the weight of the tubular. In this way, the outer support surface acts as a swage and expands the sleeve by a swage expansion process.

According to a third aspect of the present invention, there is provided a method of supporting a tubular within a bore, said method comprising the steps of:

providing a tubular having an outer support surface;

locating an expandable sleeve peripherally around a portion of the tubular, said sleeve defining an inner support surface;

running said tubular and expandable sleeve into a bore;

initiating relative axial movement between the outer and inner support surfaces of the tubular and the sleeve to expand at least a portion of the sleeve into engagement with a wall of the bore by interaction of the outer and inner support surfaces; and supporting the tubular via the outer and inner support surfaces.

Thus, the outer support surface of the tubular acts as a swage, which in use expands at least a portion of the sleeve into contact with the wall surface of the bore in which the tubular is located.

Preferably, the expandable sleeve is moved towards the outer support surface of the tubular while said outer support surface is held stationary. Preferably also, the sleeve is moved in an upward direction relative to the bore in order to initiate expansion of the sleeve. It should be understood that the term "upward" is used herein to define a relative direction and implies that the sleeve is moved in an up-hole direction.

According to a fourth aspect of the present invention, there is provided a method of supporting a liner within a cased bore, said method comprising the steps of:

providing a liner defining a first support surface;

locating an expandable sleeve peripherally located around said liner, said expandable sleeve defining a second support surface;

locating said liner and expandable sleeve within a cased bore;

expanding at least a portion of said sleeve into engagement with a wall of the cased bore; and supporting the liner by way of engagement of the first and second support surfaces.

According to a fifth aspect of the present invention, there is provided an apparatus for supporting a tubular within a bore, said apparatus comprising:

a first support portion for coupling to a tubular to be supported within a bore, said first support portion including a first support surface;

an expandable second support portion adapted to be expanded into contact with the bore, said second support portion including a second support surface;

wherein said first support portion is adapted to engage the second support portion to provide support for the tubular via the first and second support surfaces.

Preferably, the second support portion is adapted to be peripherally located around the tubular requiring support. The second support portion may be a sleeve or the like.

In a preferred embodiment of the present invention, the second support portion is adapted to be expanded into engagement with the bore by an expansion tool such as a roller expansion tool or a mandrel or a swage or the like. Alternatively, or additionally, the second support portion may be adapted to be expanded by interaction of the first and second support surfaces, wherein relative movement between the first and second support surfaces results in a swaged expansion of the second support portion.

Advantageously, the first support portion may be integrally formed with the tubular. Alternatively, the first support portion may be separately formed and subsequently secured to the tubular at the required location.

Preferably, the first support surface defines, at least in part, an outer, substantially frusto-conical surface portion. Preferably also, the second support surface defines, at least in part, an inner, substantially complementary frusto-conical surface portion adapted to be mated with the outer conical surface portion of the first support surface upon engagement therewith.

It should be understood that any complementary shape or configuration of the first and second support surfaces may be utilised.

Preferably, the tubular to be supported within the bore is a string of liner tubing or the like.

According to a sixth aspect of the present invention there is provided a support for use in supporting a tubular within a bore, said support comprising an expandable sleeve defining an inner support surface, wherein said expandable sleeve is adapted to be at least partially expanded into contact with a wall surface of the bore, and the inner support surface is adapted to engage the tubular to provide support therefor.

BRIEF DESCRIPTION OF THE DRAWINGS

These and other aspects of the present invention will now be described, by way of example only, with reference to the accompanying drawings, in which.

DETAILED DESCRIPTION

Figure 1:
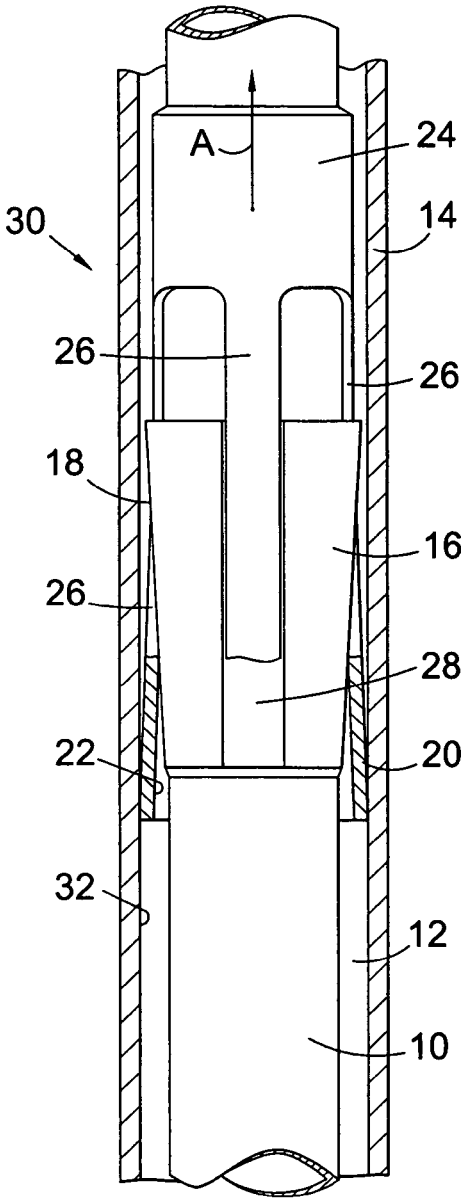
FIGS. 1 and 2 are diagrammatic representations of steps in a method of supporting a tubular within a bore, in accordance with one embodiment of the present invention.
Figure 2:
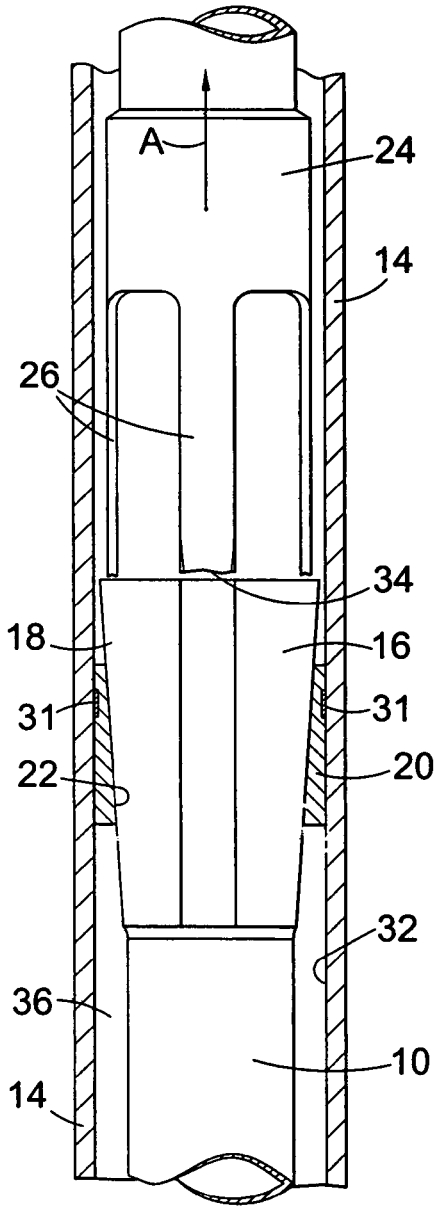

Reference is first made to FIGS. 1 and 2 of the drawings in which there are shown separate stages of a method of supporting or hanging a liner tubing string 10 within a bore 12, in accordance with an embodiment of the present invention. The bore 12 is a subterranean well bore and is supported and sealed by a casing string 14 which is cemented in place. Referring initially to FIG. 1, the liner 10 includes a conical portion 16 which defines a first support surface which is an outer tapered support surface 18. As shown, the support surface 18 tapers inwardly in a downhole direction, that is, the outer diameter of the conical portion 16 decreases in a downhole direction. Located peripherally around the liner 10 and initially below the conical portion 16, is a sleeve 20 which defines a second support surface which is an inner conical support surface 22. The sleeve is manufactured from an expandable material and is complementary to the tapered support surface 18 of the conical portion 16. For clarity, the sleeve 20 is shown in cross-section.

A piston assembly 24 is located above the conical portion 16 of the liner and is coupled to the sleeve 20 by way of a plurality (four in the embodiment shown) of straps 26. The conical portion 16 includes a corresponding number of channels 28 in the outer surface thereof to accommodate the straps 26. The piston assembly 24 is actuated by fluid pressure provided from surface.

The method of operation and use of the various components identified above will now be described with reference to FIGS. 1 and 2. The initial step involves assembling the components in the manner described above to form a liner hanger assembly 30, which is then run into the bore 12 until the required depth is reached, as shown in FIG. 1. The piston assembly 24 is then actuated to pull the sleeve 20 towards the conical portion 16 via the straps 26, in the direction of arrow A. Continued actuation of the piston assembly 24 will cause engagement of the sleeve inner conical support surface 22 with the conical portion outer tapered support surface 18, resulting in radial expansion of the sleeve 20. The sleeve 20 will thus be expanded into contact with the inner wall surface 32 of the bore, as shown in FIG. 2, to provide a hanging support for the liner 10. That is, once the sleeve 20 is expanded into contact with the bore wall 32 by interaction of the outer tapered and inner conical support surfaces 18, 22, the liner 10 will be supported by the sleeve through engagement of said support surfaces 18, 22.

In the preferred method of providing hanging support for the liner 10, the assembly 30 is located in the bore 12 and the piston assembly 24 is actuated while restraining the liner 10 (and thus the conical portion 16) from movement, to initially expand the sleeve 20 into contact with the bore wall surface 32, thus providing initial hanging support. Subsequent to this, weight is applied to the liner 10 to force the conical portion 16 in a downward direction into the bore 12, to increase the expansion force exerted on the sleeve 20 and thus increasing the grip force produced between the sleeve 20 and the bore wall 32. The piston assembly 24 is continually actuated to expand the sleeve 20 by interaction with the conical portion 16 until tensile failure of the straps 26 is achieved, as indicated by numeral 34 in FIG. 2. At this stage, the sleeve 20 will provide full support for the liner 10 via the complementary support surfaces 18, 22.

Once the liner 10 is fully supported by the sleeve 20, engagement between the sleeve 20 and the bore wall 32, and the sleeve 20 and the conical portion 16 will provide a fluid tight seal to prevent the upward flow of any fluids, such as cement, past the sleeve 20 from an annulus 36 formed between the casing 14 and the liner 10. To seek to improve sealing between the sleeve 20 and the bore wall 32, a sealing element or material 31 is provided on a portion of the outer surface of the sleeve 20.

An alternative method of providing support for a liner within a bore will now be described with reference to FIGS. 3 to 6 where an expandable sleeve 40 is set in place within a bore 42 to provide hanging support for a liner tubing string 44.

Figure 3:
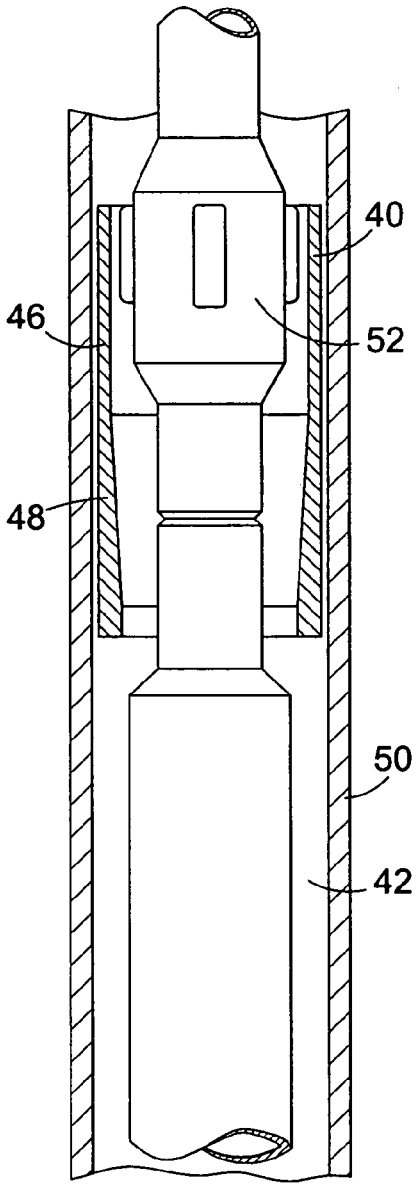
FIGS. 3 to 6 are diagrammatic representations of various steps in a method of supporting a tubular within a bore, in accordance with an alternative embodiment of the present invention.
Figure 4:
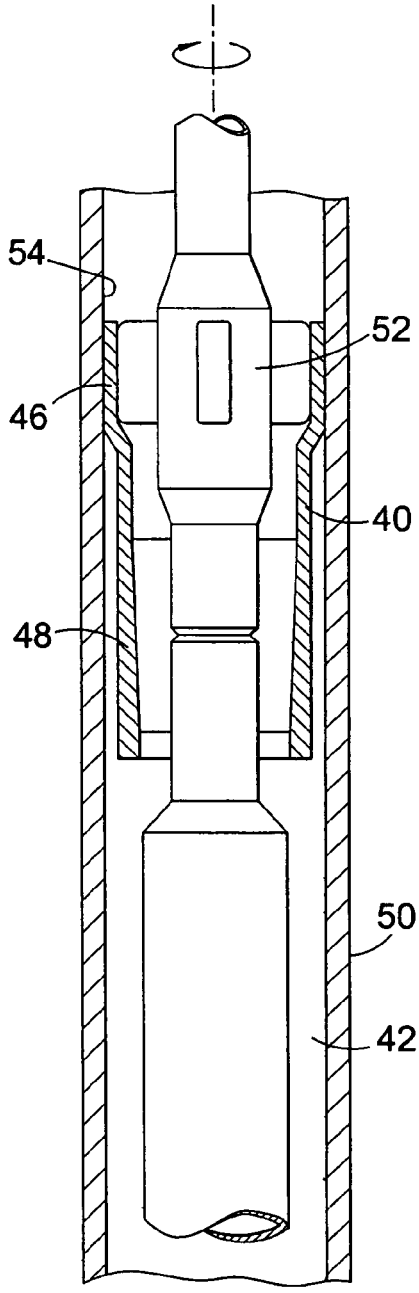
Figure 5:
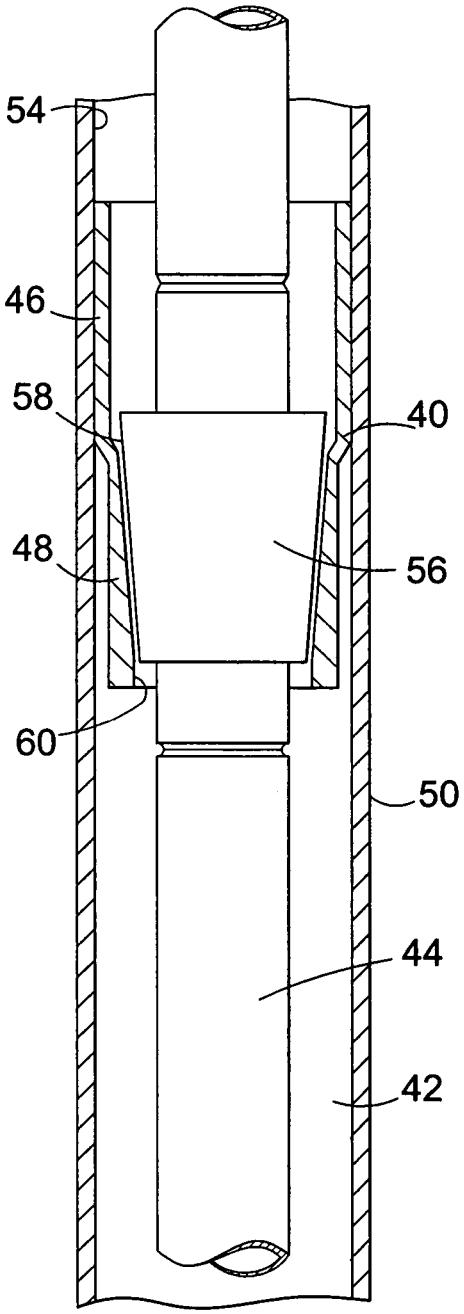

In the embodiment shown, the expandable sleeve 40 includes an upper cylindrical portion 46 and a lower conical portion 48, and is run into the bore 42, supported and sealed by casing 50, to the required depth. As shown in FIG. 3, the sleeve 40 is run into the bore 42 on a roller expansion tool 52, such as that described in WO 00/37766. Upon reaching the required depth, the roller expansion tool 52 is activated to expand the sleeve 40, and in particular the cylindrical portion 46 of the sleeve 40, into contact with the bore wall surface 54 in order to retain the sleeve within the bore 42, as shown in FIG. 4. Once the entire cylindrical portion 46, or at least a substantial portion thereof, is fully expanded into contact with the bore wall 54, the roller expansion tool 52 is removed from the bore and a string of liner tubing 44 is run in, as shown in FIG. 5. The liner 44 includes a conical portion 56 fixed relative thereto and defines an outer tapered surface 58 which corresponds to an inner tapered surface 60 of the sleeve conical portion 48. Once the conical portion 56 of the liner 10 reaches the depth of the sleeve 40 retained in the bore, engagement of the outer and inner tapered surfaces 58, 60 will prevent the liner from travelling further into the bore.

Figure 6:
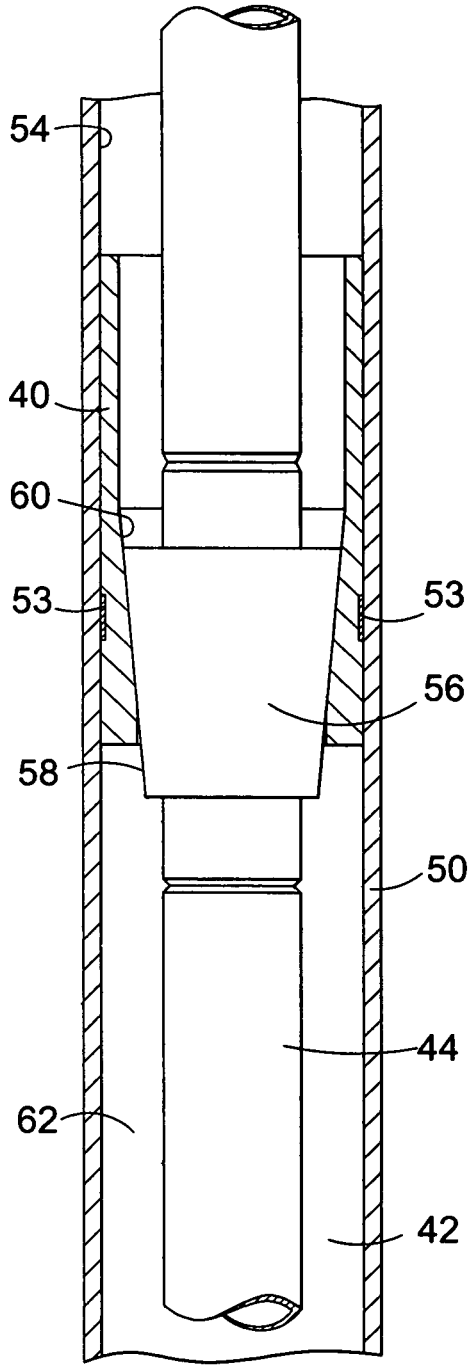

In order to ensure that the sleeve 40 will support the liner 44, the following step involves expanding the remaining portion, that is, the conical portion 48, of the sleeve 40 into contact with the bore wall surface 54. This is achieved by applying weight to the liner 44 to force the conical portion 56 of the liner through the sleeve 40, thus expanding the remaining portion of the sleeve 40 by interaction of the outer and inner tapered portions 58, 60. Thus, the conical portion 56 of the liner 44 acts as a swage expander. In this way, the entire sleeve 40 will be expanded into contact with the bore wall 54 and the liner 44 will be supported by the sleeve by engagement of the outer and inner tapered surfaces 58, 60 of the liner conical portion 56 and the sleeve conical portion 48 respectively, as shown in FIG. 6.

Once the liner 44 is fully supported by the sleeve 40, engagement between the sleeve 40 and the bore wall surface 54, and the sleeve 40 and the conical portion 56 of the liner 44 will provide a fluid tight seal to prevent the upward flow of fluid, such as cement, past the sleeve 40 from an annulus 62 formed between the casing 50 and the liner 44. To seek to improve sealing between the sleeve 40 and the bore wall 52, a sealing element or material 53 is provided on a portion of the outer surface of the sleeve 40

Figure 7:
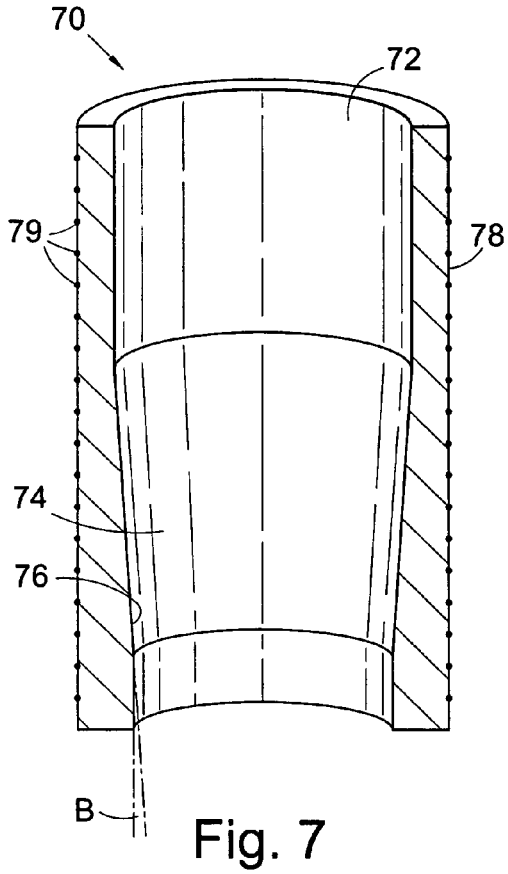
FIG. 7 is a cross-sectional perspective view of a sleeve portion used to provide support for a tubular within a bore, in accordance with an embodiment of the present invention.
Figure 8:
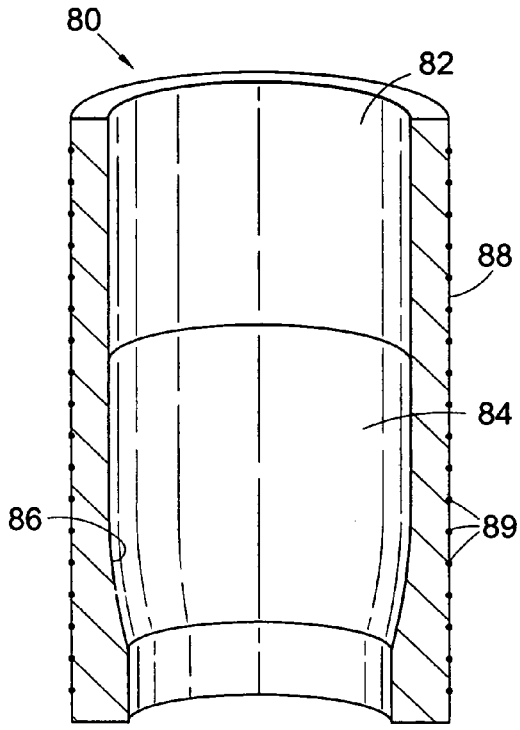
FIG. 8 is a cross-sectional perspective view of a sleeve portion used to provide support for a tubular within a bore, in accordance with an alternative embodiment of the present invention.

Reference is now made to FIGS. 7 and 8 in which there is shown cross-sectional perspective views of alternative embodiments of an expandable sleeve for use in supporting a liner within a bore. The sleeve 70 illustrated in FIG. 7 includes a cylindrical portion 72 formed with a conical portion 74. As shown, the inner diameter of the conical portion 74 decreases in a downward direction with respect to the orientation of the representation, and defines an inner conical or tapered surface 76. Thus, the sleeve 70 may be used to support a liner having a portion defining a corresponding tapered surface. The slope or angle B of the tapered surface is, in a preferred embodiment, less then 16°, and advantageously between 3 to 8°. The outer surface 78 of the sleeve 70 is textured to improve the grip between the sleeve and a bore wall surface when the sleeve is expanded into engagement therewith. In the embodiment shown, the outer surface 78 is embedded with diamond or carbide particles or buttons 79.

The sleeve 70 may be used in the method as described with reference to and as shown in FIGS. 3 to 6. Additionally, the conical portion 74 alone may be used in the method of FIGS. 1 and 2.

In the alternative embodiment shown in FIG. 8, the sleeve 80 includes an upper cylindrical portion 82 and a lower inner concave portion 84 which defines an inner concave surface 86. The inner diameter of the lower concave portion 84 generally decreases in a downwards direction with respect to the orientation of the representation. The sleeve 80 of FIG. 8 is thus adapted for use with a liner having an outer convex surface portion which complements the inner concave surface 86 of the sleeve 80. Similar to the sleeve 70 of FIG. 7, the outer surface 88 of sleeve 80 is embedded with diamond or carbide particles or buttons 89 to improve the grip against a bore wall surface when expanded into contact therewith.

The sleeve 80 may be used in the method as described with reference to and as shown in FIGS. 3 to 6. Additionally, the lower inner concave portion 84 alone may be used in the method of FIGS. 1 and 2.

Figure 9:
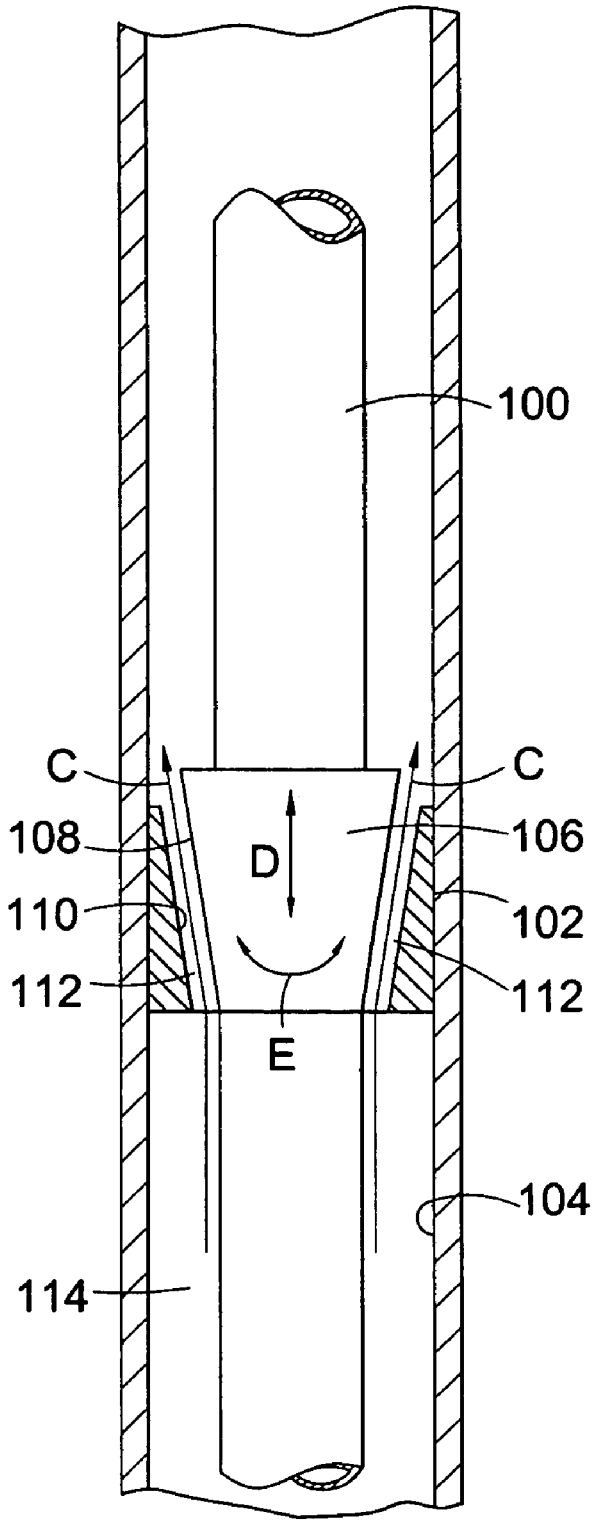
FIG. 9 is a diagrammatic representation of a preferred feature of an embodiment of the present invention.

A preferred feature of the present invention will now be described with reference to FIG. 9 of the drawings in which there is shown a liner string 100 and an expandable sleeve 102 located in a cased bore 104. The liner 100 includes a conical portion 106 which defines an outer tapered support surface 108, and the sleeve 102 defines an inner conical support surface 110, such that the liner 100 may be supported by the sleeve 102 by engagement of the support surfaces 108, 110. Once the liner 100 is supported by the sleeve 102, as shown, for example, in the embodiments of FIGS. 2 and 6, the liner 100 is adapted to be lifted from the sleeve 102 to disengage the support surfaces 108, 110 to create a flow passage 112 between the sleeve 102 and the conical portion 106 of the liner 100. The flow passage 112 allows fluid contained within an annulus 114 below the sleeve 102 to flow past the sleeve in the direction of arrows C. This feature is particularly advantageous, for example, in cementing operations where cement is flowed downwards through the liner 100 and into the annulus 114. In most cases, drilling fluid and the like will initially be contained within the annulus 114 and the flow passage 112 thus provides a means for this fluid to be displaced upon injection of cement. Once cement is injected into the annulus 114, the liner 100 is adapted to be reciprocated in longitudinal and rotary directions, as represented by arrows D and E respectively, in order to assist in circulating and evenly distributing the cement within the annulus 114.

It should be understood that the various embodiments of aspects of the present invention described and shown herein may be modified without departing from the scope of the invention. For example, any complementary shape or configuration of the expandable sleeve and the liner may be utilised as would be selected by a person of skill in the art. Additionally, in the embodiment shown in FIGS. 1 and 2, the piston assembly 24 may be connected to the sleeve by any suitable number of straps 26. Furthermore, the piston assembly 24 may be located below the sleeve 22 and thus push the sleeve towards the conical portion 16 of the liner. In the embodiment shown in FIGS. 3 to 6, initial expansion of the sleeve may be achieved by any suitable expansion tool or process, and should not be limited to roller expansion.

The expandable sleeve may be located at the required depth within the bore and prevented from travelling further into the bore by engagement with a no-go or an internal profile located within the bore on the bore wall surface.

The invention claimed is:

1. A method of supporting a tubular within a bore, said method comprising the steps of:

providing a tubular defining a first support surface;

providing an expandable sleeve adapted to be peripherally located around said tubular, said expandable sleeve defining a second support surface, wherein the inner diameter described by the second support surface decreases in a direction corresponding to a downward direction with respect to a bore in which the expandable sleeve is to be located;

locating said tubular and expandable sleeve within a bore;

plastically expanding at least a portion of said sleeve into engagement with the bore by interaction between the support surfaces, wherein an annular gap exists between the at least a portion of said sleeve and the bore prior to the expanding; and at least partially supporting the tubular by way of engagement of the first and second support surfaces.

2. A method of supporting a tubular within a bore comprising:

providing a tubular defining a first support surface;

providing an expandable sleeve adapted to be peripherally located around said tubular, said expandable sleeve defining a second support surface;

locating said tubular and expandable sleeve within a bore, wherein the expandable sleeve is located within the bore and at least partially expanded in place before the tubular is located within the bores;

plastically expanding at least a portion of said sleeve into engagement with the bore by interaction between the support surfaces, wherein an annular gap exists between the at least a portion of said sleeve and the bore prior to the expanding; and at least partially supporting the tubular by way of engagement of the first and second support surfaces.

3. A method of supporting a tubular within a bore according to claim 1, wherein the expandable sleeve and the tubular are located within the bore simultaneously.

4. A method of supporting a tubular within a bore comprising;

providing a tubular defining a first support surface;

providing an expandable sleeve adapted to be peripherally located around said tubular, said expandable sleeve defining a second support surface, wherein at least a portion of the sleeve is initially expanded into engagement with the wall surface of the bore in which the tubular is to be supported by an expansion tool;

locating said tubular and expandable sleeve within a bore;

plastically expanding at least a portion of said sleeve into engagement with the bore by interaction between the support surfaces, wherein an annular gap exists between the at least a portion of said sleeve and the bore prior to the expanding; and at least partially supporting the tubular by way of engagement of the first and second support surfaces.

5. A method of supporting a tubular within a bore according to claim 4, wherein the expansion tool is a roller expansion tool.

6. A method of supporting a tubular within a bore according to claim 4, wherein the expansion tool is an expansion cone.

7. A method of supporting a tubular within a bore according to claim 4, wherein the expandable sleeve is run into the bore on the expansion tool, and at least partially expanded into contact with the bore wall using the expansion tool to provide initial hanging support at the required depth.

8. A method of supporting a tubular within a bore according to claim 7, said method further comprising the step of running the tubular into the bore until the first support surface of the tubular engages the second support surface of the sleeve.

9. A method of supporting a tubular within a bore according to claim 8, said method further comprising the step of applying weight to the tubular to further expand the sleeve by interaction of the first and second support surfaces.

10. A method of supporting a tubular within a bore according to claim 1, said method further comprising the step of locating the expandable sleeve peripherally around the tubular in the region of the first support surface.

11. A method of supporting a tubular within a bore according to claim 10, wherein the sleeve is initially located below the first support surface of the tubular.

12. A method of supporting a tubular within a bore according to claim 10, said method further comprising the step of running the tubular and the expandable sleeve into the required bore together until the expandable sleeve is located at the required depth.

13. A method of supporting a tubular within a bore according to claim 12, said method further comprising the step of initiating relative axial movement of the tubular and expandable sleeve to cause engagement of the first and second support surface.

14. A method of supporting a tubular within a bore according to claim 13, wherein said engagement results in expansion of at least a portion of the sleeve into contact with the wall surface of the bore, providing support for the tubular via the first and second support surfaces.

15. A method of supporting a tubular within a bore according to claim 13, wherein the first support surface of the sleeve is restrained from movement while the expandable sleeve and thus the second support surface is forced into engagement with the first support surface to initiate expansion of the sleeve.

16. A method of supporting a tubular within a bore according to claim 13, wherein the expandable sleeve is held stationary while the first support surface is forced into engagement with the second support surface of the sleeve.

17. A method of supporting a tubular within a bore according to claim 16, wherein the sleeve is held stationary by a profile located on the inner wall surface of the bore, against which profile the sleeve abuts.

18. A method of supporting a tubular within a bore according to claim 16, wherein the sleeve is held stationary by fixing means associated with the tubular.

19. A method of supporting a tubular within a bore according to claim 13, wherein relative movement of the expandable sleeve and the tubular is achieved by an actuation assembly.

20. A method of supporting a tubular within a bore according to claim 19, wherein the actuation assembly is a piston assembly activated by fluid pressure.

21. A method of supporting a tubular within a bore according to claim 19, wherein the actuation assembly is a screw assembly.

22. A method of supporting a tubular within a bore according to claim 19, wherein the actuation assembly is located below the expandable sleeve and activated to push the sleeve towards the first support surface.

23. A method of supporting a tubular within a bore according to claim 19, wherein the actuation assembly is located above the expandable sleeve and the first support surface of the tubular and activated to pull the sleeve towards the first support surface.

24. A method of supporting a tubular within a bore according to claim 19, wherein the at least one actuation assembly is coupled to the expandable sleeve by at least one strap or the like.

25. A method of supporting a tubular within a bore according to claim 24, wherein the first support surface includes at least one respective channel or recess to accommodate said at least one strap.

26. A method of supporting a tubular within a bore according to claim 25, wherein the method comprises the steps of:

locating the expandable sleeve and tubular within a bore at the required depth;

restraining said tubular from movement and activating the actuation assembly to pull the sleeve, and thus the second support surface, towards the first support surface of the tubular via at least one connecting strap, thus initiating radial expansion of the sleeve into engagement with the bore wall by engagement of the first and second support surfaces to provide initial hanging support;

imparting weight on the tubular to initiate further radial expansion of the sleeve to increase the grip force between the sleeve and the bore wall; and exerting an increasing force on the sleeve by the actuation assembly to ensure sufficient expansion of the sleeve to provide support for the tubular via the complementary first and second support surfaces.

27. A method of supporting a tubular within a bore according to claim 26, wherein the method further comprises the step of inducing tensile failure of the at least one strap to ensure sufficient expansion has been achieved.

28. A method of supporting a tubular within a bore according to claim 1, wherein the first and second support surfaces of the tubular and sleeve respectively are substantially complementary in shape.

29. A method of supporting a tubular within a bore according to claim 1, wherein the outer diameter described by the first support surface decreases in a direction corresponding to a downward direction with respect to a bore in which the tubular is to be located.

30. A method of supporting a tubular within a bore according to claim 1, wherein the first support surface of the tubular defines, at least partially, an outer frusto-conical surface portion.

31. A method of supporting a tubular within a bore according to claim 30, wherein the second support surface defines, at least partially, a complementary inner frusto-conical surface portion adapted to be mated with the outer frusto-conical surface portion of the first support surface upon engagement therewith.

32. A method of supporting a tubular within a bore according to claim 31, wherein the taper of the surface portions is preferably less than around 16° from a plane substantially parallel to the longitudinal axis of the tubular.

33. A method of supporting a tubular within a bore according to claim 32, wherein the taper of the surface portions is between 3 to 8°.

34. A method of supporting a tubular within a bore according to claim 1, wherein the first support surface of the tubular defines, at least partially, an outer convex surface portion.

35. A method of supporting a tubular within a bore according to claim 34, wherein the second support surface defines, at least partially, a complementary inner concave portion adapted to be mated with the outer convex portion of the first support member upon engagement therewith.

36. A method of supporting a tubular within a bore according to claim 1, wherein the expandable sleeve includes a substantially cylindrical portion.

37. A method of supporting a tubular within a bore comprising:

providing a tubular defining a first support surface;

providing an expandable sleeve adapted to be peripherally located around said tubular, said expandable sleeve defining a second support surface, wherein the expandable sleeve includes a substantially cylindrical portion that is adapted to be at least partially expanded into engagement with a bore wall surface to provide initial hanging support before the remainder of the expandable sleeve is expanded into contact with the bore wall;

locating said tubular and expandable sleeve within a bore;

plastically expanding at least a portion of said sleeve into engagement with the bore by interaction between the support surfaces, wherein an annular gap exists between the at least a portion of said sleeve and the bore prior to the expanding; and at least partially supporting the tubular by way of engagement of the first and second support surfaces.

38. A method of supporting a tubular within a bore according to claim 36, wherein the cylindrical portion is located above the second support surface of the sleeve.

39. A method of supporting a tubular within a bore according to claim 36, wherein the cylindrical portion of the expandable sleeve is located below the second support surface.

40. A method of supporting a tubular within a bore according to claim 1, wherein at least a portion of an outer surface of the expandable sleeve is adapted to increase the friction and thus grip between the sleeve and the bore wall.

41. A method of supporting a tubular within a bore according to claim 40, wherein the outer surface of the sleeve is textured.

42. A method of supporting a tubular within a bore according to claim 40, wherein the outer surface of the sleeve includes particles embedded therein.

43. A method of supporting a tubular within a bore according to claim 42, wherein the particles are carbide buttons embedded within the outer surface of the sleeve.

44. A method of supporting a tubular within a bore according to claim 1, wherein, once the expandable sleeve is expanded and set in place within the bore, and the first and second support surfaces are in engagement such that the tubular is supported by the sleeve, sufficient sealing is provided between the outer surface of the sleeve and the bore wall, and between the first and second support surfaces to prevent the passage of any fluids past the sleeve from an annulus formed between the tubular and the bore.

45. A method of supporting a tubular within a bore according to claim 1, further comprising sealing between the sleeve and the bore wall by providing a sealing material on at least a portion of the outer surface of the sleeve.

46. A method of supporting a tubular within a bore according to claim 1, wherein the first support surface is integrally formed with the tubular.

47. A method of supporting a tubular within a bore according to claim 1, wherein the first support surface is provided on a separate component which is subsequently coupled to the tubular.

48. A method of supporting a tubular within a bore, comprising:

providing a tubular defining a first support surface, wherein the tubular to be supported within the bore is a string of liner tubing;

providing an expandable sleeve adapted to be peripherally located around said tubular, said expandable sleeve defining a second support surface;

locating said tubular and expandable sleeve within a bore;

plastically expanding at least a portion of said sleeve into engagement with the bore by interaction between the support surfaces, wherein an annular gap exists between the at least a portion of said sleeve and the bore prior to the expanding; and at least partially supporting the tubular by way of engagement of the first and second support surfaces.

49. A method of supporting a tubular within a bore according to claim 1, wherein the method further includes the step of lifting the tubular from the sleeve to disengage the first and second support surfaces, thus creating a flow passage past the sleeve from an annulus defined between the tubular and the bore wall.

50. A method of supporting a tubular within a bore according to claim 1, wherein the method further includes the step of lifting the tubular from the sleeve and reciprocating the tubular in a longitudinal and rotational direction to assist in evenly distributing a fluid within an annulus formed between the tubular and the bore wall.

51. A method of supporting a tubular within a bore according to claim 1, wherein the engagement between the first and second support surfaces of the tubular and sleeve respectively is non-permanent.

52. A method of supporting a tubular within a bore, said method comprising the steps of:

providing a tubular defining an outer support surface;

providing an expandable sleeve defining an inner support surface;

running said expandable sleeve into a bore to a first depth and expanding a portion of said sleeve into contact with the bore;

running said tubular into the bore;

engaging the outer support surface of the tubular with the inner support surface of the expandable sleeve;

applying weight to the tubular upon engagement of the outer and inner support surfaces to effect expansion of a previously unexpanded section of the sleeve by interaction of the outer and inner support surfaces; and supporting the tubular by engagement of the outer and inner support surfaces.

* * * * *

UNITED STATES PATENT AND TRADEMARK OFFICE

CERTIFICATE OF CORRECTION

PATENT NO. : 7,350,588 B2
APPLICATION NO. : 10/866320
DATED : April 1, 2008
INVENTOR(S) : Abercrombie Simpson et al.

It is certified that error appears in the above-identified patent and that said Letters Patent is hereby corrected as shown below:

Column 10, Claim 2, Line 53, please insert --,-- after bore;

Column 10, Claim 2, Line 62, please delete “bores” and insert --bore--;

Column 11, Claim 4, Line 6, please insert --,-- after bore;

Column 11, Claim 4, Line 7, please delete “;” and insert --:--;

Column 11, Claim 13, Line 59, please delete “surface” and insert --surfaces--;

Column 11, Claim 15, Line 67, please delete “sleeve” and insert --tubular--;

Column 13, Claim 37, Line 35, please insert --,-- after bore.

Signed and Sealed this

Twenty-first Day of October, 2008

JON W. DUDAS
*Director of the United States Patent and Trademark Office*